US007058342B2

(12) United States Patent
Jeon

(10) Patent No.: US 7,058,342 B2
(45) Date of Patent: Jun. 6, 2006

(54) DEVELOPING UNIT FOR IMAGE FORMING APPARATUS

(75) Inventor: Nam-gon Jeon, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 118 days.

(21) Appl. No.: 10/782,843

(22) Filed: Feb. 23, 2004

(65) Prior Publication Data

US 2005/0002698 A1 Jan. 6, 2005

(30) Foreign Application Priority Data

Jul. 2, 2003 (KR) ..... 10-2003-0044707

(51) Int. Cl.
*G03G 15/08* (2006.01)

(52) U.S. Cl. ..... 399/254; 399/119

(58) Field of Classification Search ..... 399/107, 399/119, 120, 252, 253, 254, 255, 256
See application file for complete search history.

(56) References Cited

U.S. PATENT DOCUMENTS 5,539,502 A * 7/1996 Koshino et al. ..... 399/272
5,581,334 A * 12/1996 Forlani et al. ..... 399/263
5,614,996 A * 3/1997 Tanda ..... 399/120
6,438,344 B1 * 8/2002 Fujimoto ..... 399/254
6,449,442 B1 * 9/2002 Shida et al. ..... 399/63
6,766,132 B1 * 7/2004 Sakai et al. ..... 399/256
6,871,033 B1 * 3/2005 Sato et al. ..... 399/260

* cited by examiner

*Primary Examiner*—Hoan Tran
(74) *Attorney, Agent, or Firm*—Staas & Halsey LLP

(57) ABSTRACT

A developer for an image forming apparatus includes a developing casing having a plurality of toner chambers to contain toner, an agitator having a resilient wing and rotatably disposed in the toner chamber for agitating and transferring toner, a toner supplying roller rotatably disposed adjacent to one of the toner chambers of the developing casing, a developing roller for transferring and attaching the toner supplied from the toner supplying roller to a photoconductive medium, and a partition disposed in the developing casing to separate the two toner chamber. The partition has a plurality of slits at a center potion to transfer toner from one toner chamber to another toner chamber therethrough, while the agitator rotates. Also, the partition has a rib sloped upward at a predetermined angle from a lower portion of the slit. While the agitator rotates, the resilient wing of the agitator resiliently contacts with the rib so as to splash the toner upward. The toner being splashed then drops due to gravity and moves through the slit.

14 Claims, 2 Drawing Sheets

DEVELOPING UNIT FOR IMAGE FORMING APPARATUS

CROSS-REFERENCE TO RELATED APPLICATIONS

This application claims the priority of Korean Patent Application No. 2003-44707, filed Jul. 2, 2003 in the Korean Intellectual Property Office, the disclosure of which is incorporated herein by reference.

BACKGROUND OF THE INVENTION

1. Field of the Invention

The present invention relates to an electrophotographic image forming apparatus, and more specifically, to a developer to develop an electrostatic latent image of a photoconductive medium with a toner.

2. Description of the Related Art

Conventionally, a developer for an image forming apparatus transfers toner from a developing casing to a developing roller using a toner supplying roller. The developing roller rotates and transfers the toner attached to an outer circumference thereof to a photoconductive medium so as to develop an electrostatic latent image of the photoconductive medium. Recently, as the life span and the toner capacity of developers increases, the size of toner chambers is also increasing. The toner chambers are conventionally made of a plurality of small cylinders rather than a large single cylinder in consideration of its appearance and mountability in image forming apparatuses.

FIG. 1 shows an example of a developer having a toner chamber which is formed with a plurality of the small cylinders as described above. Referring to FIG. 1, the developing casing 10 is provided with a first toner chamber 11 and a second toner chamber 12, each having a circular bottom side. The first and the second toner chambers 11 and 12 are filled with toner 13.

Further, the first and the second toner chambers 11 and 12 of the developing casing 10 are provided with agitators 20 and 20', respectively, for agitating the toner 13. The first agitator 20 (the second agitator 20' has the same structure as the first agitator 20, and therefore, only the first agitator 20 is described) includes a rotating member 21 and a resilient wing 22 attached to one end of the rotating member 21. As the resilient wing 22 rotates, one end makes contact with the wall of the first toner chamber 11 thereby agitating and transferring the toner 13.

A toner supplying roller 30 is rotatably disposed in the first toner chamber 11 of the developing casing 10. A developing roller 40 is rotatably disposed at the developing casing 10 so that the toner 13 can be supplied from the toner supplying roller 30. A regulating blade 50 to uniformly regulate the toner layered on the developing roller 40 is provided near the developing roller 40.

According to the above developer, during a printing operation, each agitator 20 and 20' rotates and agitates the toner 13 in the first and the second toner chambers 11 and 12 respectively, while also transferring the toner from the second toner chamber 12 to the first toner chamber 11. The toner is transferred to the developing roller 40 by the toner supplying roller 30 in the first toner chamber 11. Finally, the toner is transferred to a photoconductive medium (not shown) by the developing roller 40 so as to develop the electrostatic latent image of the photoconductive medium.

However, conventional developers for image forming apparatuses as aforementioned have a shortcoming in that the toner 13 is apt to accumulate in the first toner chamber 11, which usually does not have a enough space. The agitators 20 and 20' disposed in the first and the second toner chambers 11 and 12 of the developing casing 10 rotate and push the toner toward the first toner chamber 11 that is adjacent to the developing roller 30. Accordingly, the pressure of the toner in the first toner chamber 11 is increased and toner may be leaked out through both ends of the developing roller 30. In addition, the toner stress increases so that the image quality rapidly deteriorates.

SUMMARY OF THE INVENTION

An aspect of the present invention is to provide a developer for an image forming apparatus which uniformly regulates the quantity of toner which is transferred from one toner chamber to another toner chamber during development, prevents the toner from leaking out, and prevents toner stress from occurring due to the excessive toner transfer to one toner chamber.

To accomplish the above aspect, the developer according to an aspect of the present invention, comprises: a developing casing having more than two toner chambers to contain toner; agitators rotatably disposed in the toner chambers for agitating and transferring the toner, the agitators having resilient wings; a toner supplying roller rotatably disposed adjacent to one of the toner chambers of the developing casing; a developing roller to transfer and attach the toner supplied from the toner supplying roller to a photoconductive medium; and a partition disposed in the developing casing to separate the toner chambers. The partition has a plurality of slits at a center potion to transfer the toner from one toner chamber to another toner chamber therethrough while the agitators rotate.

According to an aspect of the present invention, the partition has a plurality of ribs corresponding to the plurality of slits. Each rib is sloped upward at a predetermined angle from the lower portion of the slit. While the agitator rotates, the resilient wing of the agitator contacts the rib so as to splash toner upward. The toner then drops due to gravity and moves through the slit.

Since the toner is transferred from a second toner chamber to a first toner chamber by gravity, the pressure in the toner chamber is not increased. The toner is smoothly transferred by the rotation of the agitators.

In an aspect of the present invention, the slit is formed with a width and a height of more than 2 mm, respectively.

According to a another aspect of the present invention, a developer for an image forming apparatus comprises a lower wall member extended upward form a lower portion of the developing casing, an upper wall member extended downward from an upper portion of the developing casing such that the upper wall member is at a predetermined distance from the lower wall member, and a plurality of guide ribs disposed to form a plurality of the slits between the lower wall member and the upper wall member.

While the agitator rotates, the resilient wing resiliently contacts the lower wall member and splashes the toner upward in the toner chamber.

The slit is formed in a width and a height more than 2 mm, respectively.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
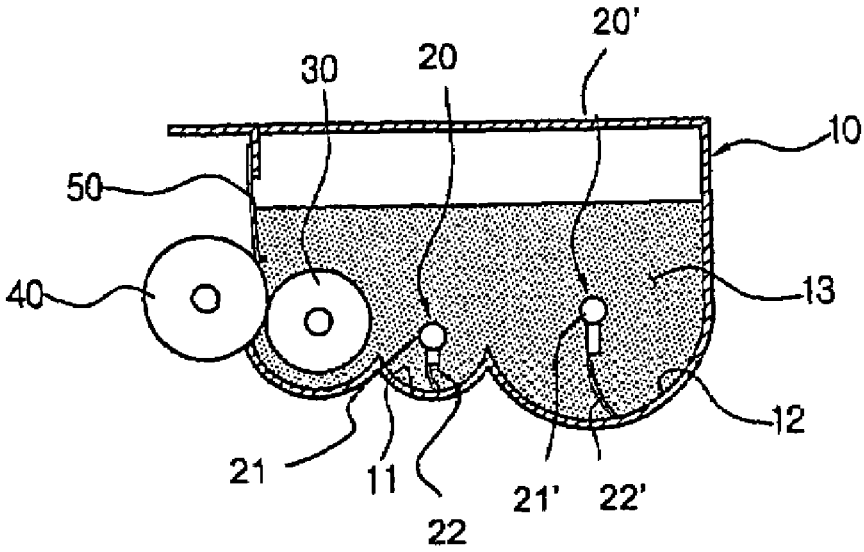
FIG. 1 is a cross-sectional view schematically showing a conventional developer for an image forming apparatus.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 2:
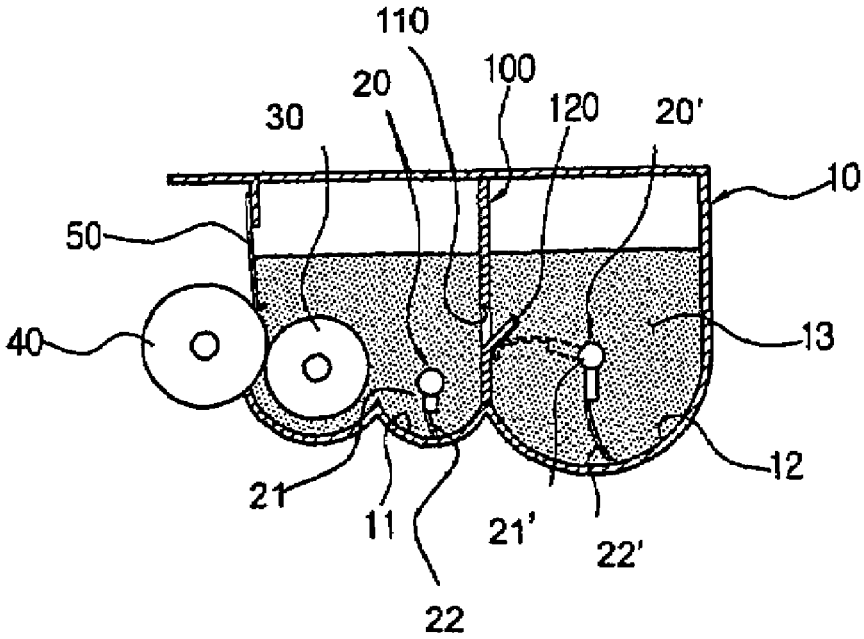
FIG. 2 is a cross-sectional view schematically showing a developer for an image forming apparatus according to an embodiment of the present invention.

As shown in FIG. 2, the developing unit of the image forming apparatus according to an embodiment of the present invention includes, a developing casing 10, agitators 20 and 20', a toner supplying roller 30, a developing roller 40, and a partition 100.

The developing casing 10 has a plurality of toner chambers, for example, a first toner chamber 11 and a second toner chamber, 12 for containing toner 13. The first and the second toner chambers 11 and 12 are filled with a predetermined quantity of toner 13. The developing casing 10 is sealed so that it does not allow toner leakage from the toner chambers 11 and 12.

The agitators 20 and 20' are rotatably disposed in the first and the second toner chambers 11 and 12 respectively. The second agitator 20' has a similar structure to the first agitator 20, and therefore, only the first agitator 20 is described. The first agitator 20 has a rotating member 21 and a resilient wing 22 extended from the rotating member 21. The resilient wing 22 is formed of such a size that it may be slightly bent by contact with the inner wall of the toner chamber 11. By the rotation of the agitators 20 and 20', the toner 13 of the toner chambers 11 and 12 is agitated and transferred from the second toner chamber 12 to the first toner chamber 11. At this time, according to an aspect of the present invention, the quantity of transferred toner is regulated to be uniform. Hence, toner leakage and toner stress due to high pressure are prevented such leakage and stress can occur due to excessive toner transfer to one toner chamber as is common in conventional developers.

The toner supplying roller 30 is rotatably disposed adjacent to the first toner chamber 11 of the developing casing 10. The developing roller 40 is disposed in association with the toner supplying roller 30 so that the toner supplied from the toner supplying roller 30 is transferred and attached to a photoconductive medium (now shown). Herein, the transference and development of the toner by the toner supplying roller 30 and the developing roller 40 are similar to those of conventional developers, and therefore a detailed description thereof is omitted.

The partition 100 is interposed between the first toner chamber 11 and the second toner chamber 12 in the developing casing 10 so as to separate the toner chambers 11 and 12. Also, at a center portion of the partition 100 a plurality of slits 110 are formed through which fluid can travel between the first and the second toner chambers 11 and 12. Accordingly, when the agitators 20 and 20' in the toner chambers 11 and 12 rotate, toner 13 is transferred from the second toner chamber 12 to the first toner chamber 11 through the slits 110. The slit 110 may be formed to have both a width and a height greater than 2 mm to allow smooth transference of the toner 13.

According to an aspect of the present invention, the partition 100 is provided with a rib 120 sloping upward at a predetermined angle from a lower portion of the slits 110. Hence, due to the rib 120, the slits 110 faces upward. The rib 120 also reduces pressure that may be applied to the first toner chamber 11 while the second agitator 20' rotates.

While the second agitator 20' rotates the resilient wing 22' of the second agitator 20' resiliently contacts the rib 120. Accordingly, the toner on the rib 120 is smoothly transferred to the first toner chamber 11 through the slits 110. The toner in the second toner chamber 12 is transferred to the first toner chamber 11 by gravity. While rotating, the resilient wing 22' of the second agitator 20' bends when it contacts the rib 120 when the resilient wing 22' is no longer in contact with the rib 120, it then spreads out to splash toner upward. The toner then falls due to the gravity and is transferred to the first toner chamber 11 along the rib 120 and through the slits 110. If the first toner chamber 11 is full of toner, the toner blocks the slits 110, and the toner above the rib 120 does not enter the first toner chamber 11. If the first toner chamber 11 is not full of toner, the slits 110 are clear and the toner on the rib 120 moves into the first toner chamber 11.

As described above toner is transferred by gravity from one toner chamber to another toner chamber uniformly and smoothly due to the rotation of the agitators 20 and 20'. Accordingly, the pressure on the toner does not increase as in conventional toner chambers where toner is excessively transferred to one toner chamber.

Figure 3:
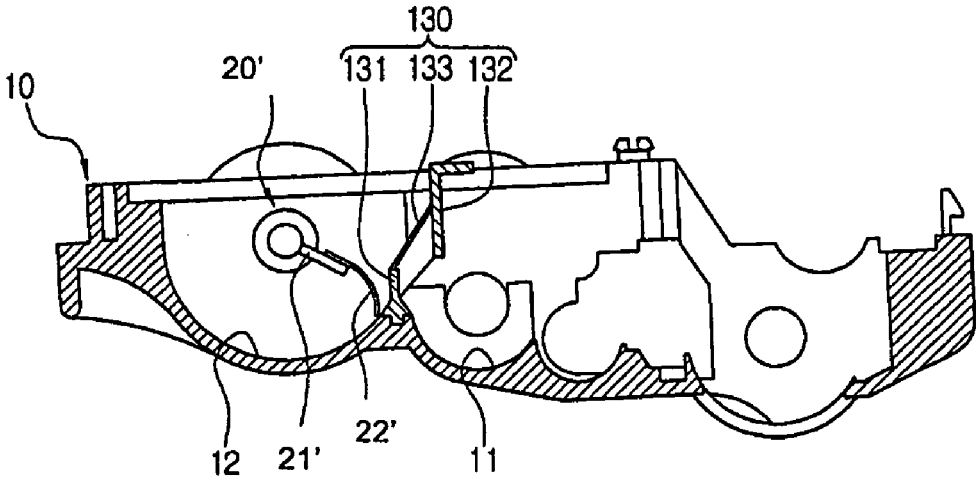
FIG. 3 is a cross-sectional view schematically showing the developer for an image forming apparatus according to an alternate embodiment of the present invention.
Figure 4:
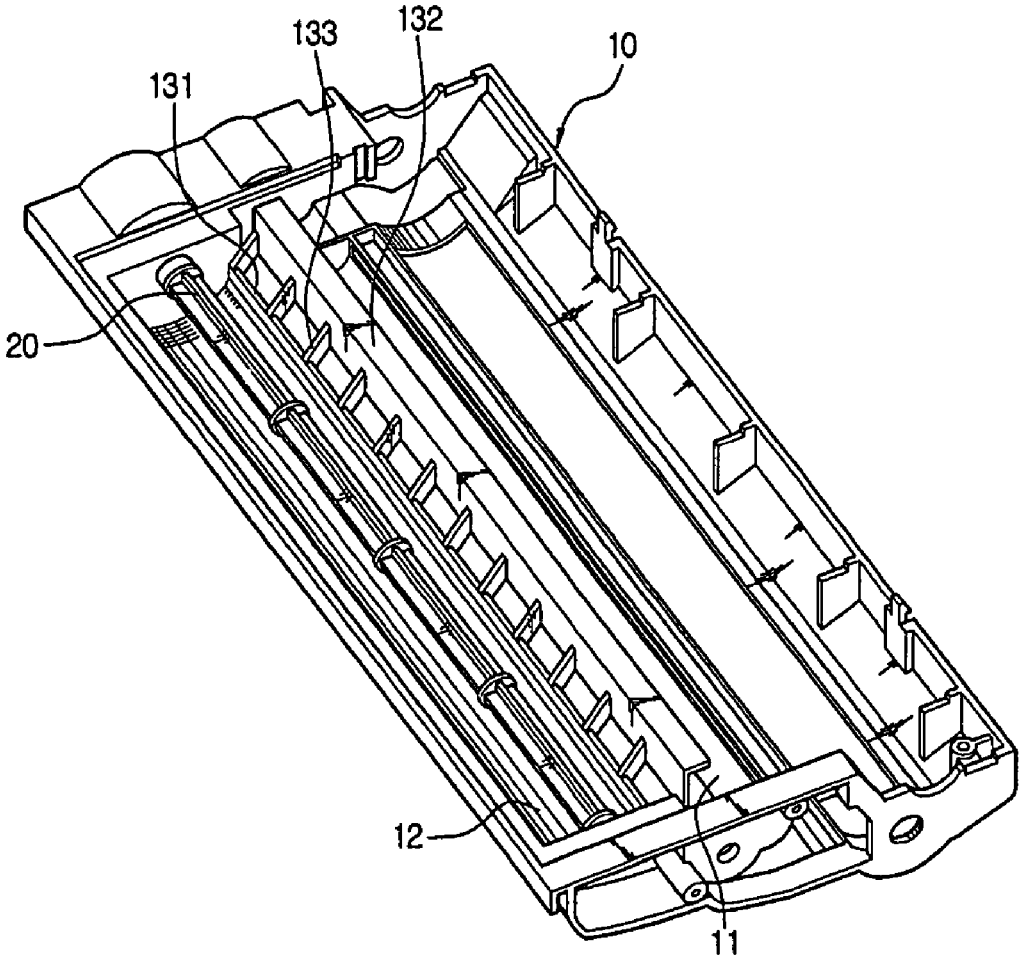
FIG. 4 is perspective view showing a developing casing of the developer of FIG. 3.

FIGS. 3 and 4 are views showing a main portion of a developer for an image forming apparatus according to an alternate embodiment of the present invention.

As shown in FIGS. 3 and 4, the developer of the image forming apparatus according to an alternate embodiment of the present invention has a similar structure to that of the previously detailed embodiment. A difference lies in the structure of the partition 130, which will be described below. Other structures of the developing unit are not described.

Referring to FIGS. 3 and 4, the partition 130 is provided with a lower wall member 131, an upper wall member 132, and a plurality of guide ribs 133 interposed between the wall members 131 and 132.

The lower wall member 131 is extended upward from a lower portion of the developing casing 10 to a predetermined height. The upper wall member 132 is extended downward from an upper portion of the developing casing 10 to a predetermined depth so as to be at a predetermined distance from the lower wall member 131. Accordingly, a space is formed between the first toner chamber 11 and the second toner chamber 12 so that toner 13 is transferred through the space formed between the upper portion to the lower portion of the developing casing 10. That is, the space serves a similar function to the slits 110 of the previous embodiment. The guide ribs 133 are formed such that they slope downward from the upper wall member 132 to the lower wall member 131. The guide ribs 133 separate the space into a plurality of spaces.

The lower wall member 131 serves a similar function to the ribs 120 of the embodiment shown in FIG. 2. While the second agitator 20' rotates, the resilient wing 22' contacts with the lower wall member 131, and splashes toner upward when it straightens.

According to the embodiment of the present invention shown in FIGS. 3 and 4, while the second agitator 20' rotates, the resilient wing 22' contacts the lower wall member 131 and splashes the toner upward in the second toner chamber 12. The toner then drops due to gravity and moves into the first toner chamber 11 through the space between the wall members 131 and 132. If the first toner chamber 11 is full of toner, the toner does not enter. Toner enters the first toner chamber 11 only when here is not too much toner in the first toner chamber 11.

Therefore, toner is not excessively moved to one toner chamber, and the toner chamber is not over pressurized, and toner is prevented from leaking out and/or from being stressed.

According to the present invention excessive amounts of toner are not forced into one toner chamber of the developing casing. The toner chamber is not over pressurized. Hence, the toner in the toner chamber is not leaked out. Further, the toner does not deteriorate due to toner stress, thus, the image quality is enhanced.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A developer for an image forming apparatus, comprising:

a developing casing having a plurality of toner chambers to contain a toner;

a plurality of agitators rotatably disposed in the toner chambers to agitate and transfer the toner, each of the agitators comprising a resilient wing;

a toner supplying roller rotatably disposed adjacent to one of the toner chambers of the developing casing;

a developing roller to transfer and attach the toner supplied from the toner supplying roller to a photoconductive medium; and at least one partition disposed in the developing casing to separate each of the toner chambers, each of the at least one partitions having a plurality of slits to transfer the toner from one toner chamber to another toner chamber therethrough while the agitators rotate, wherein each of the partitions has a rib, and wherein each rib is sloped upward at a predetermined angle from a lower portion of the slits.

2. The developer of claim 1, wherein each of the partitions has a plurality of ribs corresponding to the plurality of slits.

3. The developer of claim 2, wherein when the agitators rotate, the resilient wings of the agitators resiliently contact the ribs so as to splash the toner upward, and the toner being splashed drops due to a gravity and moves through the slits.

4. The developer of claim 3, wherein each of the plurality of resilient wings is formed such that each resilient wing is slightly bent while in contact with an inner wall of one of the plurality of toner chambers.

5. The developer of claim 3, wherein the slits are formed with a width and a height both being greater than 2 mm.

6. The developer of claim 2, wherein the plurality of toner chambers are filled with a predetermined quantity of toner.

7. The developer of claim 2, wherein the developing casing is sealed such that the plurality of toner chambers do not leak.

8. The developer of claim 1, wherein each of the plurality of partitions is a single planar member comprising a first end and a second end, each partition being disposed in the developing casing such that the first end is combined with a top of the developing case and the second end is combined with a bottom of the developing case.

9. A developer for an image forming apparatus, comprising:

a developing casing having a plurality of toner chambers to contain a toner;

a plurality of agitators rotatably disposed in the toner chambers to agitate and transfer the toner, each of the agitators comprising a resilient wing;

a toner supplying roller rotatably disposed adjacent to one of the toner chambers of the developing casing;

a developing roller to transfer and attach the toner supplied from the toner supplying roller to a photoconductive medium; and at least one partition disposed in the developing casing to separate each of the toner chambers, each of the at least one partitions having a plurality of slits to transfer the toner from one toner chamber to another toner chamber therethrough while the agitators rotate, wherein each of the partitions comprises:

a lower wall member extended upward from a lower portion of the developing casing;

an upper wall member extended downward from an upper portion of the developing casing so as to be at a predetermined distance from the lower wall member; and a plurality of guide ribs disposed to form the plurality of slits between the lower wall member and the upper wall member.

10. The developer of claim 9, wherein each of the plurality of guide ribs is formed to slope downward from the upper wall member to the lower wall member.

11. The developer of claim 9, wherein, while the agitators rotate, the resilient wings resiliently contact the lower wall members and splash the toner upward in the toner chamber.

12. The developer of claim 11, wherein the splashed toner is transferred to a first one of the plurality of toner chambers to a second one of the plurality of toner chambers by gravity.

13. The developer of claim 12, wherein if the first one of the plurality of toner chambers is full of toner, the splashed toner is not transferred.

14. The developer of claim 9, wherein the slits are formed with a width and a height both greater than 2 mm.

* * * * *